United States Patent [19]

Furuta et al.

[11] Patent Number: 4,946,596

[45] Date of Patent: Aug. 7, 1990

[54] METHOD FOR REMOVING MERCURY FROM A LIQUID HYDROCARBON

[75] Inventors: Akio Furuta; Kunio Sato; Kazuo Sato; Tooru Matsuzawa, all of Handa, Japan

[73] Assignee: JGC Corporation, Tokyo, Japan

[21] Appl. No.: 352,023

[22] Filed: May 15, 1989

[51] Int. Cl.[5] ..... B01D 15/00

[52] U.S. Cl. ..... 210/679; 210/688; 210/914

[58] Field of Search ..... 210/679, 688, 914

[56] References Cited

U.S. PATENT DOCUMENTS 4,094,777 6/1978 Sugier et al. ..... 210/688

4,474,896 10/1984 Chao ..... 210/660

*Primary Examiner*—Ivars Cintins

*Attorney, Agent, or Firm*—Cushman, Darby & Cushman

[57] ABSTRACT

Liquid hydrocarbons such as natural gas liquid generally contain elementary mercury, ionized mercury and ionizable mercury compounds. All of them are requested to be removed. Further, organic mercury compounds are contained in some natural gas liquid and other liquid hydrocarbons depending on their district of production, and its removal is also necessary.

It has been found that an adsorbent composition comprising multi-component metal sulfides supported on a carrier wherein one of metal component is molybdenum of 3–15 weight-% calculated as molybdenum metal in final product and another metal component is selected from the group consisting of cobalt and nickel, the atomic ratio of these to molybdenum being in the range of 0.05–0.9 can adsorb more amount of elemental mercury from hydrocarbons than the conventional adsorbents. It has been found further that the mercury in the forms of inorganic and organic compounds can also be adsorbed as well as elemental mercury from liquid hydrocarbons containing them by the adsorbents of the present invention.

2 Claims, 2 Drawing Sheets

METHOD FOR REMOVING MERCURY FROM A LIQUID HYDROCARBON

FIELD OF THE INVENTION

The present invention relates to an adsorbent composition for removing mercury from hydrocarbons, especially from liquid hydrocarbons, and a method for removing mercury from a liquid hydrocarbon containing mercury.

For example, a natural gas liquid (NGL), liquid hydrocarbons recovered from natural gas, contains mercury in amounts ranging from several ppb (parts per billion) to several thousands ppb depending on its district of production. The mercury causes an amalgamation corrosion of aluminum used for construction of equipments, and induces poisoning and deterioration of activity of catalysts when natural gas liquid containing mercury is used as a raw meterial in a successive catalytic reaction.

Mercury in natural gas liquid generally exists in the forms of elemental mercury, ionized mercury and ionizable mercury compounds. All of them are requested to be removed. Further, organic mercury compounds are contained in some natural gas liquid depending on its district of production, and its removal is also necessary.

DESCRIPTION OF THE PRIOR ART

Heretofore, most of the processes for removal of mercury have dealt with industrial sewages or exhaust gases of incinerators in general.

As for the natural gas, the following two methods have been proposed:

(a) cooling-condensation method, and (b) adsorption (absorption) method.

The former method is employed in natural gas liquefaction plants. However, the method is not applicable for removal of mercury from liquid hydrocarbons such as natural gas liquid, because the method includes cooling step by adiabatic expansion which is employable to gaseous material only.

The latter method uses various adsorbents; for example, an alumina or a zeolite impregnated with silver, an activated charcoal or a molecular sieve impregnated with potassium iodide or sulfur or the like. There are however, such problems in them that some of them are expensive or some of them are small in adsorption capacity, inherently or as the results of reduction of the mercury adsorbing capacity due to co-adsorption of hydrocarbons.

On the other hand, adsorbents comprising heavy metal sulfides as mercury adsorbents have already been proposed. U.S. Pat. No. 4,094,777 proposed a method for removal of mercury employing copper sulfide and U.S. Pat. No. 4,474,896 proposed polysulfide-containing adsorbent compositions for use in the adsorption of elemental mercury consisting essentially of a support; a cation seleted from the group consisting of antimony arsenic, bismuth, cadmium, cobalt, copper, gold, indium, iron, lead, manganese, molybdenum, mercury, nickel, platinum, silver, tin, tungsten, titanium, vanadium, zinc, zirconium, and mixtures thereof; and a polysulfide.

The former method using copper sulfide is mentioned in the patent specification to be able to remove mercury from gaseous or liquid hydrocarbons. However, its practical object is oriented to natural gas consisting mainly or methane containing negligible amount of liquid hydrocarbons having five or more carbon atoms with around 19 $\mu g/m^3$ of mercury. However, the effects of the method for liquid hydrocarbons such as natural gas liquid or naphtha fraction containing mercury in higher content is not disclosed at all.

In our experiment, it has been found that Hg adsorbing capacity of copper sulfide per the copper atom is small contrary to our expectation.

As for the latter method using polysulfides of heavy metals, adsorption of other type mercury than elemental mercury has not been mentioned. Further, preparation or handling of such metal polysulfides appears to be very troublesome, because the preparation of the polysulfides will be realized only by using special agents.

SUMMARY OF THE INVENTION

It is a primary object of the present invention to provide an adsorbent composition having a higher adsorbing capacity of mercury to be removed from hydrocarbons.

It is another object of the present invention to provide an adsorbent composition which can catch ionized mercury, ionizable mercury compound and organic mercury compounds as well as elemental mercury.

It is further another object of the present invention to provide a method for removing mercury from a liquid hydrocarbon.

DETAILED DESCRIPTION OF THE PREFERRED EMBODIMENTS

Figure 1:
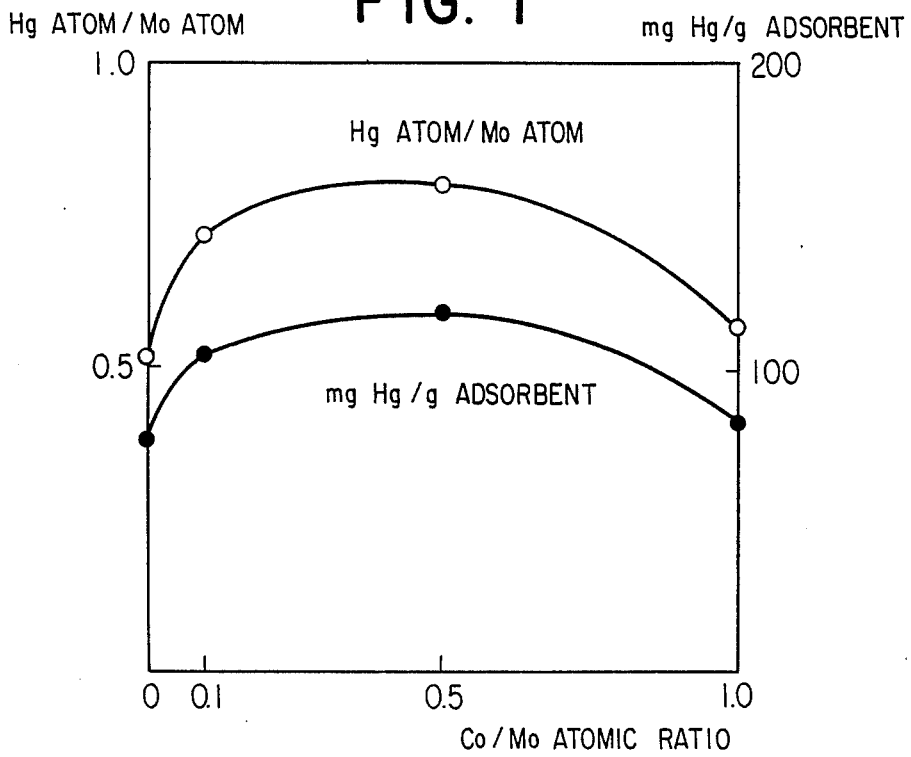
FIG. 1 shows the relation of the value of Hg atom adsorbed per Mo atom in the adsorbent in the ordinate left and the amount of Hg adsorbed by 1 gram of the adsorbent in the ordinate right againsst Co/Mo atomic ratio in the Co.Mo-sulfide adsorbent, respectively.

An adsorbent composition for removing mercury from hydrocarbons according to the present invention comprises multicomponent metal sulfides supported on a carrier wherein one of metal components is molybdenum of 3–15 weight-% calculated as molybdenum metal in final product and another metal component is selected from a group of cobalt and nickel, the atomic ratio of these to molybdenum being in the range of 0.5–0.9.

The combination of nickel or cobalt with molybdenum provides advantages such as lowering of initiation temperature of sulfurization of metal components, and the prevention of sintering of metals due to dispersion of cobalt or nickel in molybdenum sulfide crystal to give a highly dispersed sulfide on a carrier.

The highly dispersed sulfide on a carrier provides not only the increase of the adsorbing capacity of molybdenum sulfide for elemental mercury but also increase of the ability of adsorbing organic mercury compounds and ionized mercury by the adsorbent.

The adsorbent may contain other metallic or inorganic components additionally.

As the carrier, particle materials comprising silica, alumina, silica-alumina, zeolite, ceramics, glass, resins, an activated charcoal, etc. can be employed; among which alumina is most preferred.

The carrier may be preferably selected from materials with a large specific surface of 5–400 $m^2/g$, preferably of 100–250 $m^2/g$, for giving a better contacting efficacy, though these are not critical.

The adsorbent may be prepared by sulfurization of the metal components in a state supported on a carrier.

The metal components may be supported on a carrier by a impregnation method, a blending method or a coprecipitation method.

A typical method of preparation is as follows; an aqueous solution of molybdenum compound and cobalt compound is impregnated to alumina as carrier, then dried, followed by calcining at 450°–500° C. for 0.1–2 hours and sulfurized finally.

For example, ammonium paramolybdate $[(NH_4)_6Mo_7O_{24}\bullet 4H_2O]$ for molybdenum, ammonium cobalt chloride $[NH_4Cl\bullet CoCl_2\bullet 6H_2O]$ for cobalt and ammonium nickel chloride $[NH_4Cl\bullet NiCl_2\bullet 6H_2O]$ for nickel can be used as metal sources.

The sulfurization of the adsorbent can be conducted by using a mixture of hydrogen and hydrogen sulfide, in which hydrogen sulfide is contained preferably in 0.1–10 volume -%. The treatment temperature is 200°–450° C., preferably 300°–400° C.

By the way, cobalt-molybdenum catalyst or nickel-molybdenum catalyst which is generally used for desulfurization process of kerosene or light oil (VGO) in typical refinery firms, where the spent catalysts are discharged. These spent catalysts can adsorb mercury in liquid hydrocarbons effectively, because they become fully sulfurized in use. Accordingly, utilization of the spent catalysts as the adsorbent may be quite advantageous for reducing the procurement cost of adsorbent.

The contact of a liquid hydrocarbon containing mercury with the adsorbent is preferably conducted at temperatures below 200° C. Temperatures above 200° C. may release mercury from the adsorbent or may cause problems such as evaporation or cracking of the liquid hydrocarbon.

Though the contact of liquid hydrocarbons containing mercury and the adsorbent can be conducted using arbitrary methods, a fixed bed flowing method which enables a continuous operation is preferable.

The present invention can be most preferably adopted for removal of mercury from liquid hydrocarbons, for example, natural gas liquid recovered from natural gas or liquid hydrocarbons obtained by liquefaction of gases produced as a by-product of petroleum.

The adsorbent composition of the present invention may be applicable for removing mercury from natural gas.

The present invention will be illustrated hereunder in more detail by examples.

EXAMPLES AND COMPARATIVE EXAMPLES

[Preparation of adsorbents]

Ammonium paramolybdate $[(NH_4)_6Mo_7O_{24}\bullet 4H_2O]$ for molybdenum, ammonium cobalt chloride $[NH_4Cl\bullet CoCl_2\bullet 6H_2O]$ for cobalt and ammonium nickel chloride $[NH_4Cl\bullet NiCl_2\bullet 6H_2O]$ for nickel were used as metal sources.

To γ-alumina carrier particles, aqueous solution containing a measured amount of each metal component was impregnated by the pore-filling method, and they were dried at 110° C. for 12 hours, then they were calcined at 500° C. for 4 hours.

When metal content cannot fully be carried on by one time impregnation, the supplemental impregnation should be conducted after the calcination.

The calcined particles were graded in the range of 0.25–0.30 mm in diameter by 48.60 mesh sieves.

Finally, to obtain an adsorbent, sulfurization of the graded particles was conducted at 350° C. for 2 hours by passing through a hydrogen gas containing 2 volume % of hydrogen sulfide. After the sulfurization, the adsorbent was stored and handled in the atmosphere of nitrogen to prevent the oxidation handled in the atmosphere of nitrogen to prevent the oxidation by the air.

In this manner, adsorbents containing various amounts of molybdenum sulfide with cobalt sulfide or nickel sulfide were prepared.

[Measurement of adsorbed Hg]

A forced circulation batch type experimental apparatus equipped with a raw material tank, a constant capacity pump and a column to be filled with an adsorbent was used.

As the raw material, a model liquid was prepared by dissolving in light naphtha 2 ppm (parts per million) of elemental mercury.

Into a column for the experimental apparatus, 30 mg (milligrams) of an adsorbent was filled and the model liquid was passed through the column at a linear velocity of 3 cm (centimeter) per second with circulation. The concentration of Hg in the model liquid was measured continuously. When the concentration of Hg in the model liquid did not show more decrease, it was judged that the adsorbent reached to the saturation point.

When the Hg adsorbing capacity of the adsorbent was still large enough to decrease the Hg content in the model liquid to 100 ppb or below, the model liquid was exchanged to a new one and the experiment was continued up to reaching the saturation point.

[Test 1]

The experiments were made to find the saturating amount of Hg adsorbed per 1 gram of each adsorbent comprising sulfide of Mo, Mo.Co or Co respectively. The results are shown in Table 1. In Table 1, the amounts of Mo sulfide and Co sulfide are shown as the wt. % of metal per the adsorbent.

TABLE 1

| experiment No. | adsorbent composition wt. % Mo | Co | Co/Mo atomic ratio | saturated amount of Hg adsorbed by adsorbent mg Hg/g adsorbent | Hg atom/ Mo atom |
|---|---|---|---|---|---|
| 1 | 4.0 | 0 | 0 | 47 | 0.56 |
| 2 | 4.0 | 0.7 | 0.3 | 69 | 0.83 |
| | | | | mg Hg/g | Hg atom/ |

TABLE 1-continued

| experiment No. | adsorbent composition wt. % Mo | Co | Co/Mo atomic ratio | saturated amount of Hg adsorbed by adsorbent mg Hg/g adsorbent | Hg atom/ Mo atom |
|---|---|---|---|---|---|
| | | | | adsorbent | Co atom |
| 3 | 0 | 10.3 | | 22 | 0.06 |

The experiment 2 showed that combination of Co and Mo remarkable increased the Hg adsorbing capacity compared to the experiment 1 wherein molybdenum sulfide only was used. The cobalt sulfide only also showed a small absorbing capacity per cobalt atom as shown in experiment 3.

[Test 2]

To search a preferably ratio of cobalt to be added to molybdenum, adsorbents containing 7.0 wt. % (as metal) of molybdenum sulfide and various amounts of cobalt sulfide were tested. The results are shown in Table 2 and in FIG. 1.

TABLE 2

| experiment No. | adsorbent composition wt. % Mo | Co | Co/Mo atomic ratio | saturated amount of Hg adsorbed by adsorbent mg Hg/g adsorbent | Hg atom/ Mo atom |
|---|---|---|---|---|---|
| 4 | 7.0 | 0 | 0 | 75 | 0.51 |
| 5 | 7.0 | 0.4 | 0.1 | 104 | 0.71 |
| 6 | 7.0 | 2.1 | 0.5 | 117 | 0.80 |
| 7 | 7.0 | 4.0 | 1.0 | 83 | 0.57 |

With the increase of cobalt, the Hg adsorbing capacity molybdenum sulfide per Mo atom and the saturating amount of Hg adsorbed per 1 gram of the adsorbent were increased to reach a peak at about 0.5 of the atomic ratio of Co/Mo, and then decreased gradually.

From FIG. 1, it can be observed that Hg adsorbing capacity of molybdenum sulfide per Mo atom and the saturating amount of Hg adsorbed per 1 gram of the adsorbent were remarkably larger than those of the adsorbent comprsing Mo sulfide only, in the range of 0.05–0.9, especially in the range of 0.1–0.8 of the atomic ratio of Co/Mo.

[Test 3]

To search a preferable amount of Mo to be supported on a carrier, adsorbents comprising various amounts of Mo in a constant Co/Mo atomic ratio of 0.3 were tested respectively. The results are shown in Table 3 and in FIG. 2.

TABLE 3

| experiment No. | adsorbent composition wt. % Mo | Co | Co/Mo atomic ratio | saturated amount of Hg adsorbed by adsorbent mg Hg/g adsorbent | Hg atom/ Mo atom |
|---|---|---|---|---|---|
| 2 | 4.0 | 0.7 | 0.3 | 69 | 0.83 |
| 8 | 5.0 | 0.9 | 0.3 | 84 | 0.81 |
| 9 | 10.0 | 1.8 | 0.3 | 129 | 0.62 |
| 10 | 12.0 | 2.2 | 0.3 | 150 | 0.60 |
| 11 | 20.0 | 3.7 | 0.3 | 166 | 0.40 |

With the increase of Mo content, the amount of Hg which is adsorbed per 1 gram of the adsorbent was increased, but became almost constant when the Mo content became over 15 wt. % as metal.

However, the Hg adsorbing capacity of molybdenum sulfide per Mo atom was decreased linearly.

Figure 2:
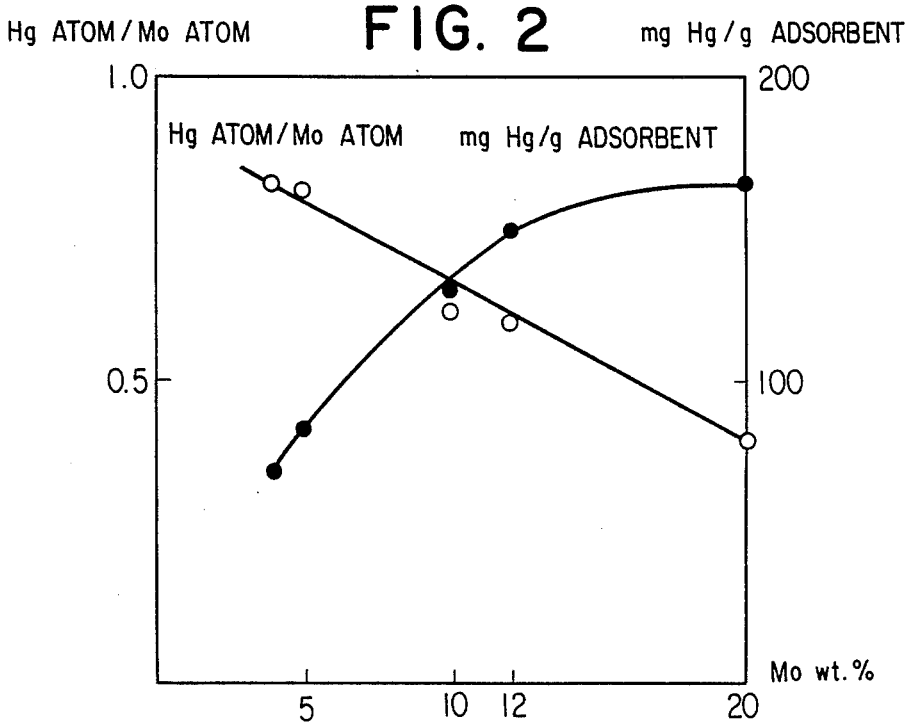
FIG. 2 shows the relation of the value of Hg atom adsorbed per Mo atom in the adsorbent in the ordinate left and the amount of Hg adsorbed by 1 gram of the adsorbent in the ordinate right against Mo content (as metal) in the Co.Mo-sulfide adsorbent, respectively.

From FIG. 2, it can be observed that the suitable amount of Mo sulfide to be supported on a carrier is in the range of 3–15 wt. % (as metal), preferably in the range of 4–12 wt. % (as metal) per the adsorbent.

[Test 4]

The experiments were made to find saturating amount of Hg adsorbed per 1 gram of each adsorbent comprising sulfide of Mo, Mo.Ni or Ni. The results are shown in Table 4. In Table 4 and following tables, the amounts of Mo sulfide and Ni sulfide are shown as the wt. % of metal per the adsorbent.

TABLE 4

| experiment No. | adsorbent composition wt. % Mo | Ni | Ni/Mo atomic ratio | saturated amount of Hg adsorbed by adsorbent mg Hg/g adsorbent | Hg atom/ Mo atom |
|---|---|---|---|---|---|
| 1 | 4.0 | 0 | 0 | 47 | 0.56 |
| 12 | 4.0 | 0.7 | 0.3 | 71 | 0.85 |
| | | | | mg Hg/g adsorbent | Hg atom/ Ni atom |
| 13 | 0 | 9.8 | | 38 | 0.11 |

The experiment 12 showed that combination of Ni and Mo remarkably increased the Hg adsorbing capacity of molybdenum sulfide per Mo atom and the saturating amount of Hg adsorbed per 1 gram of the adsorbent compared to the experiment 1 wherein molybdenum sulfide only was used. The nickel sulfide only showed a small absorbing capacity per nickel atom as shown in experiment 13.

[Test 5]

To search a preferable ratio of nickel to be added to molybdenum, adsorbents comprising 7.0 wt. % (as metal) of molybdenum sulfide and various amounts of nickel sulfide were tested. The results are shown in Table 5 and in FIG. 3.

TABLE 5

| experiment No. | adsorbent composition wt. % Mo | Ni | Ni/Mo atomic ratio | saturated amount of Hg adsorbed by adsorbent mg Hg/g adsorbent | Hg atom/ Mo atom |
|---|---|---|---|---|---|
| 4 | 7.0 | 0 | 0 | 75 | 0.51 |
| 14 | 7.0 | 0.4 | 0.1 | 107 | 0.73 |
| 15 | 7.0 | 2.1 | 0.5 | 120 | 0.82 |
| 16 | 7.0 | 4.0 | 1.0 | 88 | 0.60 |

With the increase of nickel sulfide, the Hg absorbing capacity of molybdenum sulfide per Mo atom and the saturating amount of Hg adsorbed per 1 gram of the adsorbent were increased to reach a peak at about 0.5 of the atomic ratio of Ni/Mo, and then decreased gradually.

Figure 3:
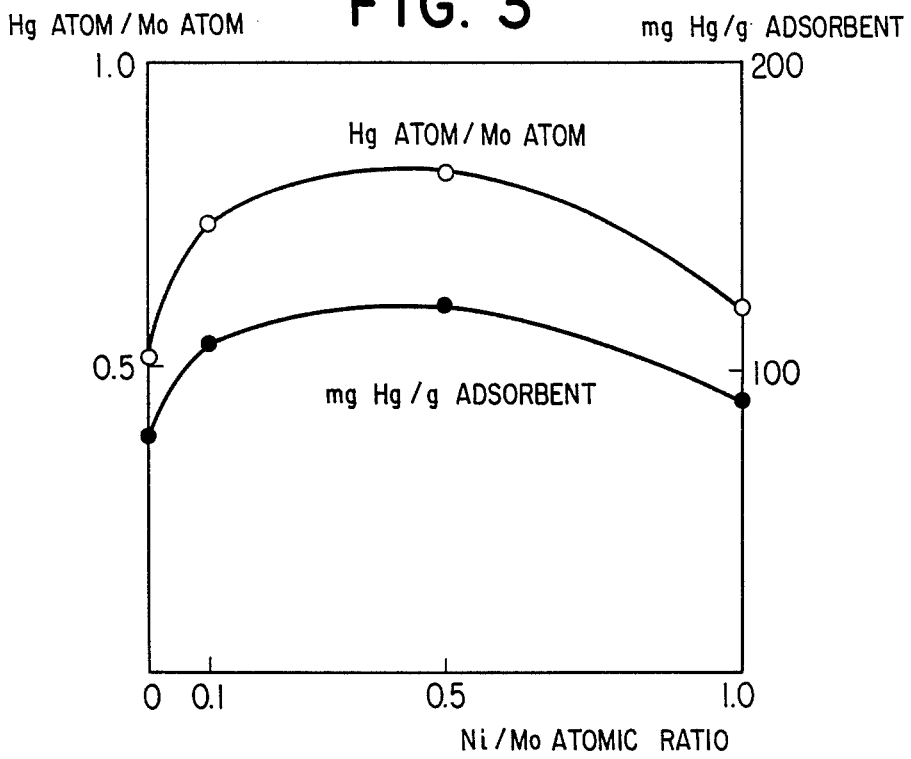
FIG. 3 shows the relation of the value of Hg atom adsorbed per Mo atom in the adsorbent in the ordinate left and the amount of Hg adsorbed by 1 gram of the adsorbent in the ordinate right against Ni/Mo atomic ratio in the Ni.Mo-sulfide adsorbent, respectively.

From FIG. 3, it can be observed that Hg adsorbing capacity of molybdenum sulfide per Mo atom and the saturating amount of Hg adsorbed per 1 gram of the adsorbent were remarkably larger than those of the adsorbent comprising Mo sulfide only, in the range of 0.05–0.9, especially in the range of 0.1–0.8 of the atomic ratio of Ni/Mo.

[Test 6]

To search a preferable amount of Mo to be supported on a carrier, adsorbents comprising various amounts of Mo in a constant Ni/Mo atomic ratio of 0.3 were tested. The results are shown in Table 6 and in FIG. 4.

TABLE 6

| experiment No. | adsorbent composition wt. % Mo | Ni | Ni/Mo atomic ratio | saturated amount of Hg adsorbed by adsorbent mg Hg/g adsorbent | Hg atom/ Mo atom |
|---|---|---|---|---|---|
| 12 | 4.0 | 0.7 | 0.3 | 71 | 0.85 |
| 17 | 5.0 | 1.0 | 0.3 | 88 | 0.85 |
| 18 | 10.0 | 1.8 | 0.3 | 139 | 0.67 |
| 19 | 12.0 | 2.1 | 0.3 | 153 | 0.61 |
| 20 | 20.0 | 3.8 | 0.3 | 183 | 0.44 |

With the increase of Mo content, the amount of Hg which is adsorbed per 1 gram of the adsorbent was increased, but the increasing rate became sluggish when the Mo content became over 15 wt. % as metal.

On the other hand, the Hg adsorbing capacity of molybdenum sulfide per Mo atom was decreased linearly.

Figure 4:
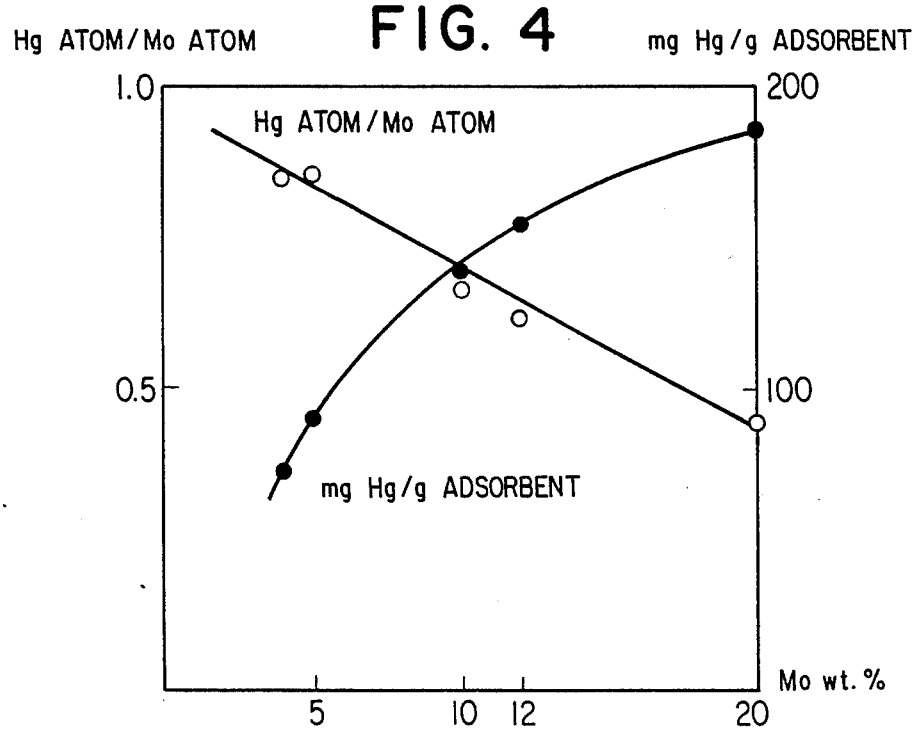
FIG. 4 shows the relation of the value of Hg atom adsorbed per Mo atom in the adsorbent in the ordinate left and the amount of Hg adsorbed by 1 gram of the adsorbent in the ordinate right against Mo content (as metal) in the Ni.Mo-sulfide adsorbent, respectively.

From FIG. 4, it can be observed that the suitable amount of Mo sulfide to be supported on a carrier is in the range of 3–15 wt. % (as metal), preferably in the range of 4–12 wt. % (as metal) per the adsorbent.

[Test 7]

Using conventional CuS or FeS adsorbent, saturating amount of Hg caught by these adsorbents were measured. The results are shown in Table 7.

TABLE 7

| experiment No. | adsorbent composition sulfide | wt. % as metal | saturated amount of Hg adsorbed by adsorbent mg Hg/g adsorbent | Hg atom/ Metal atom |
|---|---|---|---|---|
| 21 | Cu | 8.4 | 80 | 0.44 |
| 22 | Fe | 8.8 | 17 | 0.05 |

The conventional CuS adsorbent and FeS adsorbent showed smaller adsorbing capacities of Hg compared to the adsorbents of the present invention.

[Test 8]

To investigate the types of mercury which can be adsorbed by the adsorbent of the present invention, model liquids were prepared by dissolving in light naphtha each of mercury dichloride [$HgCl_2$], diethylmercury [$(C_2H_5)_2Hg$] or mercury methylchloride [$CH_3HgCl$] to make Hg content 2 ppm, respectively.

Each of the model liquids was contacted with an absorbent composed of multi-component metal sulfides supported on γ-alumina carrier wherein the binary metal sulfide is consisted of molybdenum sulfide corresponding to 6.4 wt. % of molybdenum metal per the adsorbent and cobalt sulfide corresponding to 2.8 wt. % of cobalt metal per the adsorbent (Co/Mo atomic ratio is 0.7). The results are shown in Table 8.

TABLE 8

| experiment No. | mercury compounds | saturated amount of Hg adsorbed by adsorbent mg Hg/g adsorbent |
|---|---|---|
| 23 | $HgCl_2$ | 42 |
| 24 | $(C_2H_5)_2Hg$ | 30 |
| 25 | $CH_3HgCl$ | 18 |

Table 8 shows that inorganic mercury compound ($HgCl_2$) and organic mercury compounds ($(C_2H_5)_2Hg$ and $CH_3HgCl$) in liquid hydrocarbons can be caught by the adsorbent of the present invention though the saturated amount of Hg adsorbed by the adsorbent is smaller than that for elemental mercury.

We claim:

1. A method for removing mercury from a liquid hydrocarbon containing mercury, comprising the following steps:

contacting the liquid hydrocarbon with an adsorbent composed of multi-component metal sulfide supported on a carrier wherein one of the metal components in said multi-component metal sulfide is molybdenum, said molybdenum being 3–15 weight-% of the adsorbent calculated as molybdenum metal and a second metal component in said multi-component metal sulfide is selected from the group consisting of cobalt and nickel, the atomic ratio of said second metal component to molybdenum being in the range of 0.05–0.9.

2. A method for removing mercury according to claim 1, wherein the molybdenum component in the adsorbent is 4–12 weight-% calculated as molybdenum metal and the atomic ratio of said second metal component to molybdenum is in the range of 0.1–0.8.

* * * * *